US006952148B2

(12) United States Patent
Snyder et al.

(10) Patent No.: US 6,952,148 B2
(45) **Date of Patent: *Oct. 4, 2005**

(54) RF DELAY LINES WITH VARIABLE DISPLACEMENT FLUIDIC DIELECTRIC

(75) Inventors: Steven Robert Snyder, Palm Bay, FL (US); Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 47 days.

This patent is subject to a terminal disclaimer.

(21) Appl. No.: 10/387,209

(22) Filed: Mar. 11, 2003

(65) Prior Publication Data

US 2004/0178865 A1 Sep. 16, 2004

(51) Int. Cl.[7] ..... H01P 1/18
(52) U.S. Cl. ..... 333/156; 333/161
(58) Field of Search ..... 333/35, 156, 167, 333/174, 205, 161, 175

(56) References Cited

U.S. PATENT DOCUMENTS 5,162,972 A * 11/1992 Gripshover et al. ..... 361/277
5,260,665 A * 11/1993 Goldberg et al. ..... 324/636
6,515,235 B2 * 2/2003 Moller ..... 174/256
6,556,102 B1 * 4/2003 Sengupta et al. ..... 333/161

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1, 2003, Rawnick et al.

(Continued)

*Primary Examiner*—Dinh T. Le
(74) *Attorney, Agent, or Firm*—Sacco & Associates, P.A.

(57) ABSTRACT

A continuously variable true time delay line (100) and method for producing a time delay. The true delay line (100) includes an RF transmission line (110) and at least a first fluidic dielectric (130) contained in a cavity (109) coupled to the RF transmission line along at least a first length thereof. One or more variable displacement fluid processors (120) are provided for changing a distribution of the fluid dielectric (130) in the cavity (109) in response to a time delay control signal (137). The propagation delay of the line is selectively varied by changing the distribution of the fluid dielectric in the cavity.

29 Claims, 3 Drawing Sheets

OTHER PUBLICATIONS

U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/300,455, filed Nov. 19, 2002, Brown et al.

* cited by examiner

RF DELAY LINES WITH VARIABLE DISPLACEMENT FLUIDIC DIELECTRIC

STATEMENT REGARDING FEDERALLY SPONSORED RESEARCH OR DEVELOPMENT

The United States Government has rights in this invention pursuant to Contract No. NRO000-02-C-0388 between the National Reconnaissance Office and Harris Corporation.

BACKGROUND OF THE INVENTION

1. Statement of the Technical Field

The present invention relates to the field of delay lines, and more particularly to variable RF delay lines.

2. Description of the Related Art

Delay lines are used for a wide variety of signal processing applications. For example, broadband time delay circuits are used in beam-forming applications in phased array antennas. Typical fixed geometry, true time delay circuits used in phased array antennas are comprised of switched lengths of transmission line. Despite the importance of broadband delay lines in such systems, the conventional approach to designing and implementing these components suffer from a number of drawbacks. For example, conventional delay line devices often require a relatively large number of RF switches that can result in signal losses. Also, conventional time delay circuits can be limited with regard to the delay resolution that can be achieved.

RF delay lines are often formed as ordinary transmission lines coupled to a dielectric. Depending upon the structure of the transmission line, the dielectric can be arranged in different ways. For example, microstrip, stripline circuits commonly are formed on a dielectric substrate. Two important characteristics of dielectric materials are permittivity (sometimes called the relative permittivity or $\epsilon_r$) and permeability (sometimes referred to as relative permeability or $\mu_r$). The relative permittivity and permeability determine the propagation velocity of a signal, which is approximately inversely proportional to $\sqrt{\mu\epsilon}$. The propagation velocity directly effect the electrical length of a transmission line and therefore the amount of delay introduced to signals that traverse the line.

Further, ignoring loss, the characteristic impedance of a transmission line, such as stripline or microstrip, is equal to $\sqrt{L_l/C_l}$ where $L_l$ is the inductance per unit length and $C_l$ is the capacitance per unit length. The values of $L_l$ and $C_l$ are generally determined by the permittivity and the permeability of the dielectric material(s) used to separate the transmission line structures as well as the physical geometry and spacing of the line structures.

For a given geometry, an increase in dielectric permittivity or permeability necessary for providing increased time delay will generally cause the characteristic impedance of the line to change. However, this is not a problem where only a fixed delay is needed, since the geometry of the transmission line can be readily designed and fabricated to achieve the proper characteristic impedance. When a variable time delay is needed, however, such techniques have traditionally been viewed as impractical because of the obvious difficulties in dynamically varying the permittivity and/or permeability of a dielectric board substrate material and/or dynamically varying transmission line geometries. Accordingly, the only practical solution has been to design variable delay lines using conventional fixed length RF transmission lines with delay variability achieved using a series of electronically controlled switches.

SUMMARY OF THE INVENTION

A continuously variable true time delay line. The true delay line includes an RF transmission line and at least a first fluidic dielectric contained in a cavity. The fluid dielectric is coupled to the RF transmission line along at least a first length thereof. One or more variable displacement fluid processors are provided for changing a distribution of the fluid dielectric in the cavity in response to a time delay control signal. The propagation delay of the line is selectively varied by changing the distribution of the fluid dielectric in the cavity.

According to one embodiment, the true time delay line further includes a second fluidic dielectric coupled to the RF transmission line along a second portion thereof. In that case, the first fluidic dielectric can have a first permittivity that is different from a second permittivity of the second fluidic dielectric. The first fluidic dielectric can also have a first permeability different from a second permeability of the second fluid dielectric. The variable displacement fluid processor changes a distribution of the first and second fluidic dielectric relative to the transmission line.

The first and second fluidic dielectrics are advantageously contained within a cavity portion of the transmission line. The cavity portion can extend along a length of the transmission line and the distribution of the first and second fluidic dielectrics can be varied along the length of the cavity.

The transmission line can also be coupled to a solid dielectric substrate material. The solid dielectric substrate can be any of a wide variety of conventional dielectrics such as a ceramic material. For example, the solid dielectric substrate can be formed from a low temperature co-fired ceramic.

According to one aspect of the invention, the first and second fluidic dielectrics can be immiscible. In that case the first and second fluidic dielectrics can be separated by an immiscible fluid interface.

The variable displacement fluid processor can comprise at least one high volume pump for coarse adjustment of the distribution and one low volume displacement pump for fine adjustment of the distribution. It can also include at least one fluid conduit for communicating each of the first and second fluidic dielectrics to the cavity. A first fluid port can be used to communicate the first fluidic dielectric from the conduit to the cavity portion and a second fluid port can communicate the second fluidic dielectric from a second conduit to the cavity portion, with the immiscible fluid interface separating the first and second fluid dielectrics.

The fluidic dielectrics described herein can be comprised of an industrial solvent. The industrial solvent can have a suspension of magnetic particles contained therein for controlling permeability of the fluidic dielectric. The magnetic particles are formed of a material selected from the group consisting of ferrite, metallic salts, and organo-metallic particles.

The invention also concerns a method for producing a variable delay for an RF signal using the structure as described above. The method includes the steps of propagating the RF signal along an RF transmission line and dynamically changing a distribution of the first fluidic dielectric coupled to the RF transmission line in response to a time delay control signal to vary a propagation delay of the transmission line. The method also can include the step of controlling the distribution of the first fluidic dielectric and a second fluidic dielectric coupled to the transmission line.

DETAILED DESCRIPTION OF THE INVENTION

Figure 1:
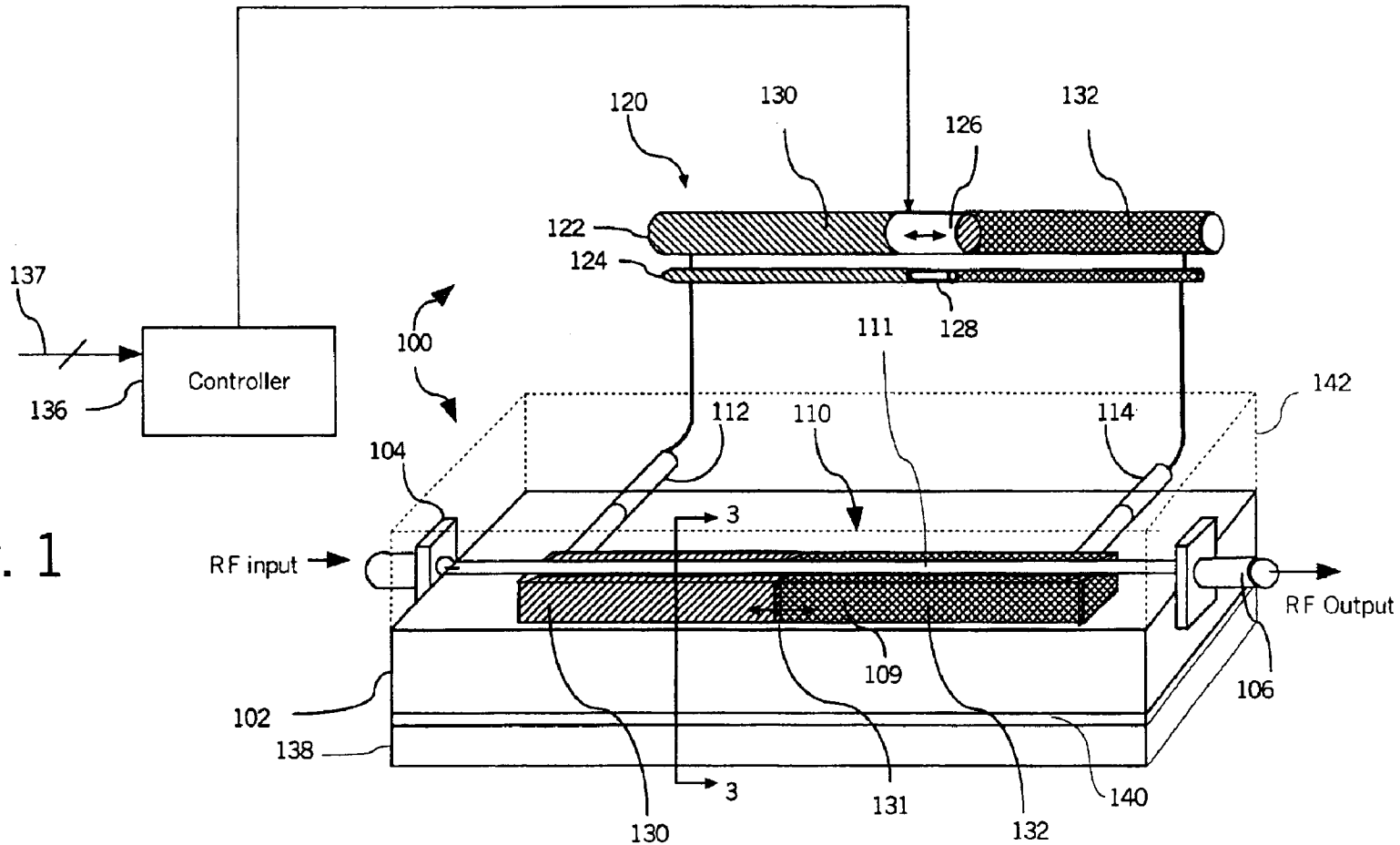
FIG. 1 is a block diagram useful for understanding the variable delay line of the invention.

FIG. 1 is a conceptual diagram that is useful for understanding the continuously variable time delay line of the present invention. The delay line apparatus 100 includes an RF transmission line 110 at least partially coupled to a fluidic dielectric 130 along a first portion thereof. The fluidic dielectric 130 is constrained within a cavity region 109 that is generally positioned relative to the RF transmission line 110 so as to be electrically and magnetically coupled thereto. In FIG. 1, the RF transmission line is comprised of a conductor 111 suspended over a ground plane 140, but the invention is not limited to any particular type of transmission line. Instead, it should be understood that the invention as described herein can be used with any type of transmission line structure that can be coupled to a fluidic cavity as shall hereinafter be described in greater detail.

According to a preferred embodiment, the volume and shape of the fluid 130 that is coupled to the transmission line 110 can be selectively varied to dynamically change the propagation delay for signals transmitted on the transmission line. More particularly, the portion of the length of transmission line conductor 111 that is coupled to the fluid 130 in cavity 109 can be dynamically controlled.

A variable displacement processor is provided for dynamically controlling the portion of the conductor 111 to which the fluidic dielectric 130 is coupled. The variable displacement processor includes at least one controller 136 that is responsive to a control signal 137, and associated fluid control mechanisms for selectively varying the volume and shape of fluidic dielectric 110 coupled to the transmission line conductor. The controller can be in the form of a microprocessor with associated memory, a general purpose computer, or could be implemented as a simple look-up table.

Any suitable means can be used to implement the variable displacement processor provided that the arrangement is capable of dynamically varying a distribution of the fluidic dielectric coupled to the transmission line 110. For example, the variable displacement processor can include one or more pumps and a series of selectively controlled gates or check valves for controlling the distribution of the fluidic dielectric beneath transmission line 110 in cavity region 109. However, according to a preferred embodiment shown in FIG. 1, a more simplified variable displacement processor can be implemented by making use of at least two fluidic dielectric materials that are immiscible. As used herein, the term immiscible refers to any fluids that will generally tend not to be susceptible to mixing and which will form an immiscible fluid interface when contained in a shared cavity. For example, oil and water based fluids are dielectric fluids that are immiscible.

As shown in FIG. 1, the second fluidic dielectric 132 is preferably coupled to the RF transmission line 110 along a second portion thereof distinct from the first portion of the transmission line to which the first dielectric is coupled. Further, the second fluidic dielectric preferably has permittivity and/or a permeability that is different from the first fluidic dielectric. Since the propagation velocity of a signal is approximately inversely proportional to $\sqrt{\mu\epsilon}$, the different permittivity and/or permeability of the first and second fluidic dielectrics will cause the propagation velocity (and therefore the amount of delay introduced)) to be different for signals on the portion of the transmission line coupled to the first dielectric 130 as compared to the portion coupled to the second fluidic dielectric 132. By selectively varying the portions of the transmission line conductor 111 that are coupled to the first dielectric and the second dielectric, the total time delay of the transmission line 110 can be continuously varied.

Further, if the two fluidic dielectrics are immiscible, then an immiscible fluid interface 131 will be formed between the first fluidic dielectric 130 and the second fluidic dielectric 132 when the two fluids are contained within the cavity 109. For example, if one of the fluidic dielectrics is water based and the second fluidic dielectric is oil based, then an immiscible fluid interface will be formed between them. In the oil and water example, it may also be necessary to change the physical orientation of the transmission line 110 and the associated cavity 109 to a vertical orientation to make effective use of the tendency of these liquid's tendency to separate above and below one another. However, the invention is not so limited and any other suitable set of immiscible fluids can be used for this purpose provided that they have, or can be made to have, the desired electrical and magnetic properties.

According to a preferred embodiment, the distribution and movement of the fluidic dielectrics within the cavity 109 can be controlled by a variable displacement fluid processor 120. As shown in FIG. 1, the variable displacement fluid processor 120 can be comprised of at least one displacement piston pump configured for changing a distribution of the first and second fluidic dielectrics relative to the transmission line 110. According to a preferred embodiment, greater accuracy of adjustments can be achieved with processor 120 by making use of a combination of pumps. For example, a high volume displacement piston pump 122 can be used for coarse adjustments and a low volume displacement piston pump 124 can be used for fine adjustments. Pistons 126 and 128 respectively can force the displacement of fluidic dielectrics 130, 132 so as to control the relative portion of the transmission line to which each fluidic dielectric is coupled. The control of each of the pumps can be coordinated by the controller 136. Of course, other types of fluid displacement mechanisms can also be used and the invention is not intended to be limited to displacement piston pumps. Instead, any suitable mechanism can be used provided that it is capable of displacing the relative distribution of the first and second fluidic dielectrics within the cavity 109.

According to the embodiment of FIG. 1, the variable displacement processor can also include two or more fluid conduits 112, 114 for communicating each of the first and second fluidic dielectrics to the cavity 109. A fluid port (not shown) associated with fluid conduit 112 can be used to communicate the first fluidic dielectric from the conduit to the cavity portion 109 and a second fluid port (not shown) can communicate the second fluidic dielectric from the second conduit 114 to the cavity portion 109. Selecting fluidic dielectrics 130, 132 to be immiscible results in an immiscible fluid interface 131 being formed between the two fluidic dielectrics 130, 132 when they are introduced within the cavity 109. Thereafter, by selectively controlling the displacement of fluidic dielectrics 130, 132 within the cavity region 109, the effective dielectric constant and permeability of the dielectric can be selectively varied in the portions of cavity 109 coupled to the transmission line 110. Since the propagation delay of any transmission line is determined by the permittivity and permeability of the surrounding dielectric, the variable displacement processor 120 can be used to control the time delay associated with RF signals passing through transmission line 110.

According to a preferred embodiment, the permittivity and the permeability of the first and second fluidic dielectrics are selected so as to maintain a constant characteristic impedance for the transmission line 110. However, the invention is not so limited in that relatively small mismatches in impedance between portions of the line may be tolerable in certain applications.

Composition of the Fluidic Dielectrics

Each of the first and second fluidic dielectrics can be comprised of any fluid composition having the required characteristics of permittivity and permeability as may be necessary for achieving a selected range of delay. Those skilled in the art will recognize that one or more component parts can be mixed together to produce a desired permeability and permittivity required for a particular time delay and transmission line characteristic impedance. In this regard, it will be readily appreciated that fluid miscibility is a key consideration to ensure proper mixing of the component parts of each of the first and second fluidic dielectric. However, the selection of miscible component parts for the creation of each fluidic dielectric is not to be confused with the concept that the preference that the first fluidic dielectric 130 should be immiscible with the second fluidic dielectric 132.

Each of the first and second fluidic dielectrics 130, 132 also preferably has a relatively low loss tangent to minimize the amount of RF energy lost in the delay line device. However, devices with higher insertion loss may be acceptable in some instances so this may not be a critical factor. Many applications also require delay lines with a broadband response. Accordingly, it may be desirable in many instances to select fluidic dielectrics that have a relatively constant response over a broad range of frequencies.

Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the first and second fluidic dielectrics as described herein, it should be noted that the invention is not so limited. Instead, the composition of the first and second fluidic dielectrics could be formed in other ways. All such techniques will be understood to be included within the scope of the invention.

Those skilled in the art will recognize that a nominal value of permittivity ($\epsilon_r$) for fluids is approximately 2.0. However, the fluidic dielectrics used herein can include fluids with higher values of permittivity. For example, the first or second fluidic dielectric material could be selected to have a permittivity values of between 2.0 and about 58, depending upon the amount of delay required. Similarly, the fluidic dielectric compositions can have a wide range of permeability values.

High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

Example of materials that could be used to produce fluidic dielectric materials as described herein would include oil (low permittivity, low permeability), a solvent (high permittivity, low permeability) and a magnetic fluid, such as combination of a solvent and a ferrite (high permittivity and high permeability). A hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferrofluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity. Similar techniques could be used to produce fluidic dielectrics with higher permittivity. For example, fluid permittivity could be increased by adding high permittivity powders such as barium titanate manufactured by Ferro Corporation of Cleveland, Ohio. For broadband applications, the fluids would not have significant resonances over the frequency band of interest.

Several sets of immiscible fluid candidates exist. One example of suitable set of immiscible fluids would be acetone and certain perfluoropolyethers (PFPE) oils. PFPE oils are available under the brand name Fomblin® from Solvay Solexis, Inc. of Thorofare, N.J. Another example of a suitable set of immiscible fluids would be deionized water and a silicone-based fluid such as MRF-336AG, which is available from Lord Corporation of Cary, N.C. A variety of other groups of immiscible fluids are also possible within the scope of the invention and the foregoing examples are not intended in any way to limit the scope of the invention.

Controlling the Variable Displacement Processor

Figure 2:
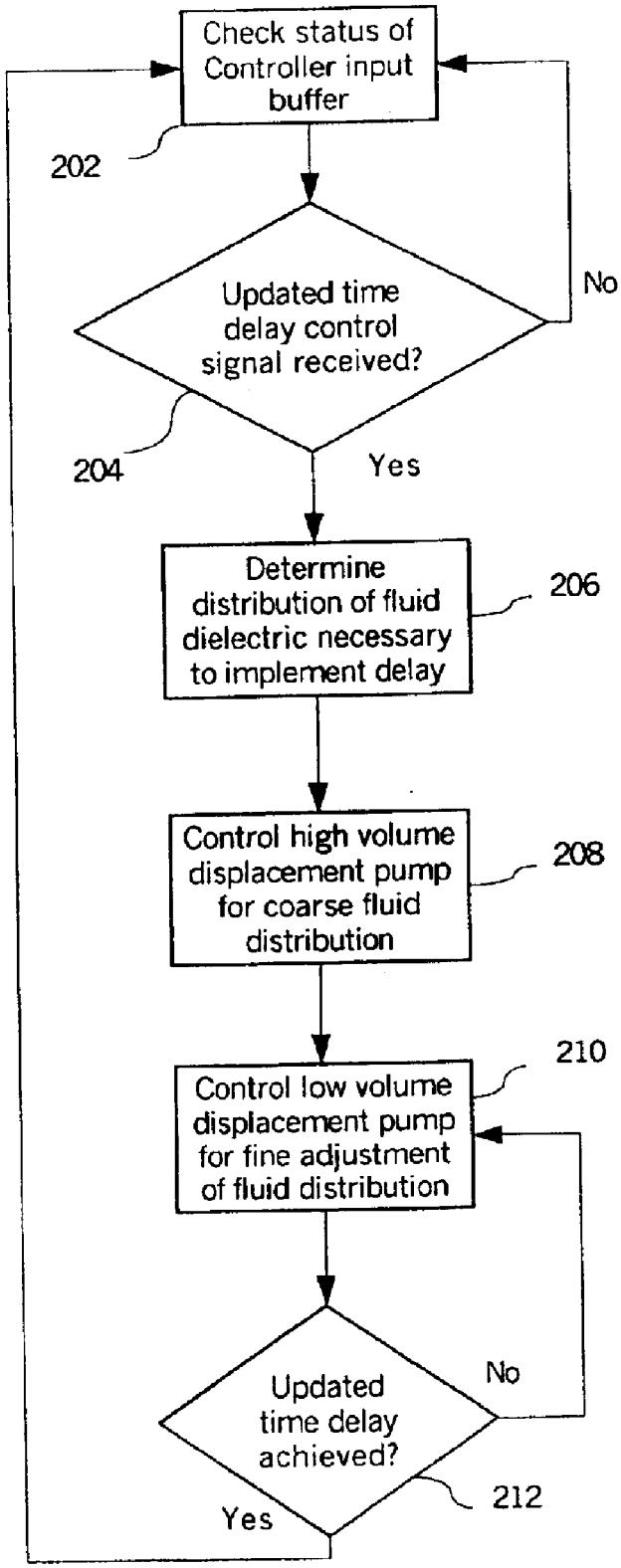
FIG. 2 is a flow chart that is useful for understanding the process of the invention.

FIG. 2 is a flowchart illustrating a process for producing a variable time delay in accordance with a preferred embodiment of the invention. The process can begin in step 202 by controller 136 continually checking the status of an input buffer (not shown) for receiving control signal 137. In step 204, if the controller determines that an updated time delay control signal has been received on the control signal input line then the controller 136 continues on to step 206. Otherwise, the controller returns to step 202 for checking the input status.

In step 206, the controller 136 can determine the necessary distribution of the fluidic dielectric materials in cavity 109 for producing the amount of delay indicated by the updated control signal. For example, if the first and second fluidic dielectrics are arranged as shown in FIG. 1, then the controller can determine approximately where the interface 131 must be relative to the length of the transmission line 110 in order to implement the necessary amount of time delay. The required location of the interface 131 can be determined by one of several means One method would be to calculate the total time delay for the transmission line 110. Given the permittivity and permeability of the fluid dielectrics, and any surrounding solid dielectric, the propagation velocity could be calculated for the portions of the transmission line coupled to each of the first and second fluidic dielectrics 130, 131. These values could be calculated each time a new delay time request is received or could be stored in a memory associated with controller 136. In either case, the controller can use this information to calculate the necessary location for the fluid interface 131 required to implement a particular amount of delay specified. Once the required location of the interface 131 has been calculated, the controller can control the displacement fluid processor 120 in step 206 to move high volume displacement pump piston 126 to provide a coarse adjustment of the location of the fluid interface 131. Fine adjustments can be made in step 210 using the low volume displacement pump.

As an alternative to calculating the necessary location for the fluid interface 131, the controller 136 could also make use of a look-up-table (LUT). The LUT can contain cross-reference information for determining control data for the distribution of the fluidic dielectric material necessary to achieve various different delay times. For example, a calibration process could be used to identify the specific digital control signal values communicated from controller 136 to displacement fluid processor 120 that are necessary to adjust the relative position of pistons 126 and/or 128 to achieve a set of specific delay values. These digital control signal values could then be stored in the LUT. Thereafter, when control signal 137 is updated to a new requested delay time, the controller 136 can immediately obtain the corresponding digital control signal for causing displacing fluid processor 120 to move pistons 126 and 128 to the proper position for producing the required delay.

As an alternative, or in addition to the foregoing methods, the controller 136 could make use of an empirical approach that injects a signal at RF input port 104 and measures the delay to RF output port 106. As shown in step 212, the system could check to see whether the updated time delay had been achieved. A feedback loop could then be employed to control the displacement pump 122 and/or 124 to produce the desired delay characteristic.

Those skilled in the art will recognize that a wide variety of alternatives could be used to adjust the distribution of the fluid dielectrics. Accordingly, the specific implementations described herein are intended to be merely examples and should not be construed as limiting the invention.

RF Unit Structure, Materials and Fabrication

In theory, constant characteristic impedance can be obtained for a transmission line by maintaining a constant ratio of permittivity to permeability in the dielectric to which the line is coupled. Accordingly, in those instances where the transmission line is for all practical purposes coupled exclusively to the fluidic dielectic, then it is merely necessary to maintain a constant ratio of $\epsilon_r/\mu_r$, where $\epsilon_r$ is the permittivity of the fluidic dielectric, and $\mu_r$ is the permeability of the fluidic dielectric. A cross-sectional view of such a line is illustrated in FIG. 3*a*.

Figure 3A:
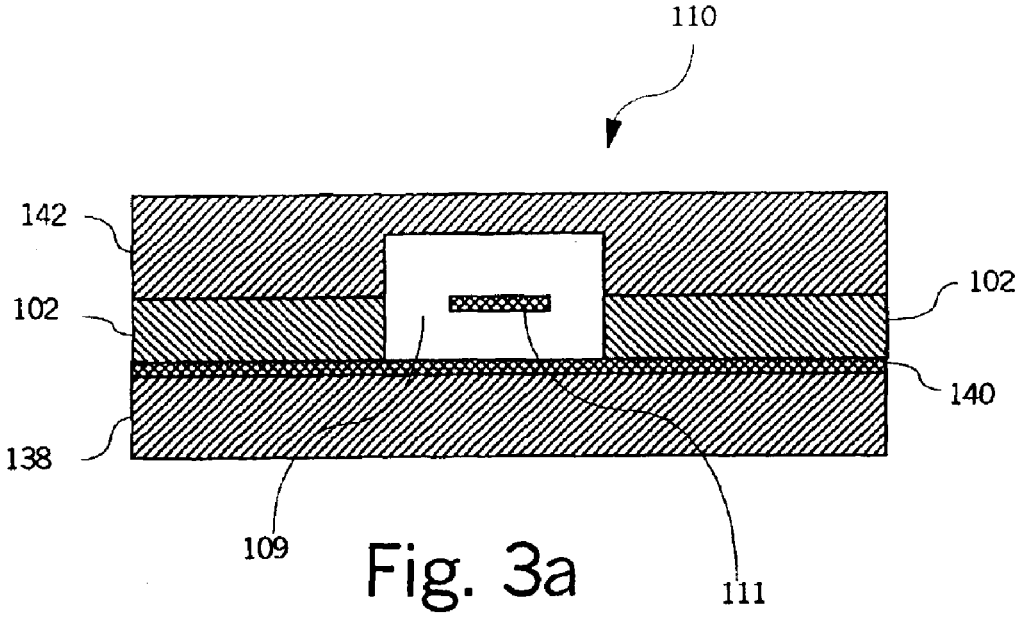
FIG. 3*a* is a cross-sectional view of the transmission line structure in FIG. 1, taken along line 3—3

FIG. 3*a* is a cross-sectional view of one embodiment of the transmission line structure in FIG. 1, taken along line 3—3, that is useful for understanding the invention. As illustrated therein, cavity 109 can be formed in substrate 102 and continued in cap substrate 142 so that the fluidic dielectric is closely coupled to transmission line 110 on all sides of conductor 111. The conductor 111 is suspended within the cavity 109 as shown. A ground plane 140 is disposed below the conductor 111 between substrate 102 and base substrate 138.

Figure 3B:
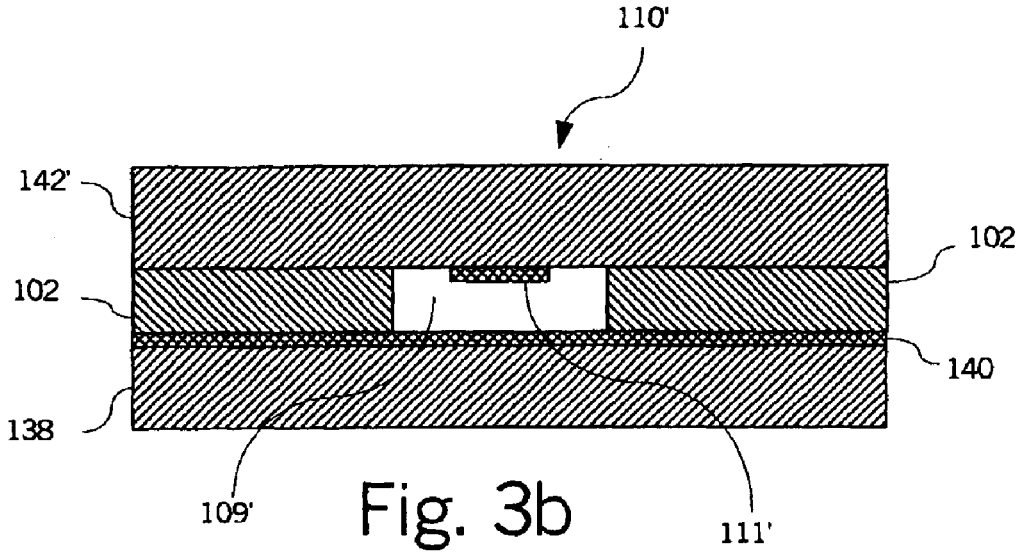
FIG. 3*b* is a cross-sectional view of an alternative embodiment of a transmission line structure of FIG. 1.

FIG. 3*b* is a cross-sectional view showing an alternative transmission line structure 110' for a delay line in which the cavity structure 109' extends on only one side of the conductor 111' and the conductor 111' is partially coupled to the solid dielectric substrate 142'. In the case where the transmission line is also partially coupled to a solid dielectric, then the permeability $\mu_r$ necessary to keep the characteristic impedance of the line constant can be expressed as follows:

$$\mu_r=\mu_{r,sub}(\epsilon_r/\epsilon_{r,sub})$$

where $\mu_{r,sub}$ is the permeability of the solid dielectric substrate 142, $\epsilon_r$ is the permittivity of the fluidic dielectric 108 and $\epsilon_{r,sub}$ is the permittivity of the solid dielectric substrate 142.

Transmission line impedance is not independent of the transmission line structure. However, it is always proportional to the square root of the ratio of the permeability to the permittivity of the media in which the conducting structures are embedded. Thus, for any transmission line, if both the permeability and permittivity are changed in the same proportion, and no other changes are made, the impedance will remain constant. The equation specified enforces the condition of a constant ratio of $\mu$ to $\epsilon$, and thus ensures constant impedance for all transmission line structures.

Likewise, the effective index describing the velocity of the wave $n_{eff}$, is approximately equal to $n_{O,eff}(\epsilon_r/\epsilon_{r,sub})$ where $n_{O,eff}$ is the effective index of refraction in the absence of fluidic dielectric 108, $\epsilon_r$ is the permittivity of the fluidic dielectric 108 and $\epsilon_{r,sub}$ is the permittivity of the solid dielectric substrate 142. At this point it should be noted that while the embodiment of the invention in FIG. 1 and 3 is shown essentially in the form of a buried microstrip construction, the invention herein is not intended to be so limited. Instead, the invention can be implemented using any type of transmission line by replacing at least a portion of a conventional solid dielectric material that is normally coupled to the transmission line with a fluidic dielectric as described herein. For example, and without limitation, the invention can be implemented in transmission line configurations including conventional waveguides, stripline, microstrip, coaxial lines, and embedded coplanar waveguides. All such structures are intended to be within the scope of the invention.

According to one aspect of the invention, the solid dielectric substrate 102, 138, 142 can be formed from a ceramic material. For example, the solid dielectric substrate can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention.

We claim:

1. A continuously variable true time delay line, comprising:

an RF transmission line;

a first fluidic dielectric contained in a cavity and coupled to said RF transmission line along at least a first length thereof, a second fluidic dielectric contained in said cavity and coupled to said RF transmission line along at least a second length thereof, said first and second fluidic dielectrics being separated by an immiscible fluid interface;

at least one variable displacement fluid processor for dynamically changing a distribution of said first and second fluidic dielectrics in said cavity in response to a time delay control signal;

wherein a propagation delay of said line is selectively varied by changing said distribution of said fluid dielectrics in said cavity.

2. The true time delay line according to claim 1 wherein said transmission line is also coupled to a solid dielectric substrate material.

3. The true time delay line according to claim 2 wherein $n_{eff}$, an effective index describing a velocity of a wave in said transmission line is approximately equal to $n_{O,eff}$ $(\epsilon_r/\epsilon_{r,sub})$ where $n_{O,eff}$ is an effective index of refraction in an absence of fluidic dielectric, $\epsilon_r$ a permittivity of the fluidic dielectric, and $\epsilon_{r,sub}$ is a permittivity of the solid dielectric substrate.

4. The true time delay line according to claim 2 wherein said solid dielectric substrate is formed from a ceramic material.

5. The true time delay line according to claim 2 wherein said solid dielectric substrate is formed from a low temperature co-fired ceramic.

6. The true time delay line according to claim 1 wherein said fluidic dielectric is comprised of an industrial solvent.

7. A continuously variable true time delay line, comprising:

an RF transmission line;

a first fluidic dielectric contained in a cavity and coupled to said RF transmission line along at least a first length thereof;

a second fluidic dielectric coupled to said RF transmission line along a second length thereof, said first fluidic dielectric having at least one of a first permittivity and a first permeability that is different respectively from at least one of a second permittivity and a second permeability of said second fluidic dielectric; and at least one variable displacement fluid processor for changing a distribution of said first and second fluidic dielectric relative to said transmission line in response to a time delay control signal to selectively vary a propagation delay of said transmission line.

8. The true time delay line according to claim 7 wherein said first and second fluidic dielectrics are contained within said cavity.

9. The true time delay line according to claim 8 wherein said cavity extends along a length of said transmission line and said distribution of said first and second fluidic dielectrics is varied along a length of said cavity.

10. The true time delay line according to claim 7 wherein said first and second fluidic dielectrics are immiscible.

11. The true time delay line according to claim 7 wherein said first and second fluidic dielectrics are separated by an immiscible fluid interface.

12. The true time delay line according to claim 7 wherein said variable displacement fluid processor comprises at least one fluid conduit for communicating each of said first and second fluidic dielectrics to said cavity.

13. The true time delay line according to claim 12 further comprising a first fluid port communicating said first fluidic dielectric from said conduit to said cavity portion and a second fluid port communicating said second fluidic dielectric from a second conduit to said cavity portion, and an immiscible fluid interface separating said first and second fluid dielectrics.

14. A continuously variable true time delay line, comprising:

an RF transmission line;

a first fluidic dielectric contained in a cavity and coupled to said RF transmission line along at least a first length thereof;

at least one variable displacement fluid processor for changing a distribution of said fluidic dielectric in said cavity in response to a time delay control signal;

wherein a propagation delay of said line is selectively varied by changing said distribution of said fluid dielectric in said cavity;

wherein said variable displacement fluid processor comprises at least one high volume pump for coarse adjustment of said distribution and one low volume displacement pump for fine adjustment of said distribution.

15. A continuously variable true time delay line, comprising:

an RF transmission line;

a first fluidic dielectric having at least one component comprised of an industrial solvent that has a suspension of magnetic particles contained therein, said first fluidic dielectric contained in a cavity and coupled to said RF transmission line along at least a first length thereof;

at least one variable displacement fluid processor for dynamically changing a distribution of said fluidic dielectric in said cavity in response to a time delay control signal;

wherein a propagation delay of said line is selectively varied by changing said distribution of said fluid dielectric in said cavity.

16. The true delay line according to claim 15 wherein said magnetic particles are formed of a material selected from the group consisting of ferrite, metallic salts, and organometallic particles.

17. A method for producing a variable delay for an RF signal comprising the steps of:

propagating said RF signal along an RF transmission line;

dynamically changing a distribution of a first fluidic dielectric and a second fluidic dielectric coupled to said RF transmission line in response to a time delay control signal to vary a propagation delay of said transmission line, said first and second fluidic dielectrics being separated by an immiscible fluid interface.

18. A method for producing a variable delay for an RF signal comprising the steps of;

propagating said RF signal along RF transmission line;

dynamically changing a distribution of a first fluidic dielectric coupled to said RF transmission line in response to a time delay control signal to vary a propagation delay of said transmission line;

controlling said distribution of said first fluidic dielectric and a second fluidic dielectric coupled to said transmission line.

19. The method according to claim 17 further comprising the step of coupling said transmission line to a solid dielectric substrate material.

20. The method according to claim 18 further comprising the step of selecting said first and second fluidic dielectrics to be immiscible.

21. The method according to claim 18 further comprising the step of separating said first and second fluidic dielectrics with an immiscible fluid interface.

22. The method according to claim 18 further comprising the step of pumping an increased volume of said first fluidic dielectric into a cavity coupled to said RF transmission line to displace said second fluidic dielectric.

23. The method according to claim 18 further comprising communicating said first fluidic dielectric to a cavity portion of said RF transmission line through a first fluid port and said second fluidic dielectric to said cavity portion through a second fluid port, and separating said first and second fluid dielectrics through the use of an immiscible fluid interface therebetween.

24. The method according to claim 18 further comprising the step of selecting at least one of said fluidic dielectrics to be comprised of an industrial solvent.

25. The method according to claim 18 further comprising the step of selecting at least one of said first and second fluidic dielectrics to include an industrial solvent that has a suspension of magnetic particles contained therein.

26. The method according to claim 25 further comprising the step of selecting said magnetic particles from the group consisting of ferrite, metallic salts, and organo-metallic particles.

27. The method according to claim 19 further comprising the step of selectively forming said solid dielectric substrate from a ceramic material.

28. The method according to claim 27 wherein said solid dielectric substrate is formed from a low temperature co-fired ceramic.

29. A method for producing a variable delay for an RF signal comprising the steps of:

propagating said RF signal along an RF transmission line;

dynamically changing a distribution of a first fluidic dielectric coupled to said RF transmission line in response to a time delay control signal to vary a propagation delay of said transmission line;

controlling said distribution using at least one high volume pump for coarse adjustment of said distribution and at least one low volume displacement pump for fine adjustment of said distribution.

* * * * *